US012416302B2

(12) United States Patent
Choi et al.

(10) Patent No.: US 12,416,302 B2
(45) Date of Patent: Sep. 16, 2025

(54) VARIABLE DISPLACEMENT SWASH PLATE TYPE COMPRESSOR AND CONTROL METHOD

(71) Applicant: Hanon Systems, Daejeon (KR)

(72) Inventors: Hyung In Choi, Daejeon (KR); Seong Gyu Gong, Daejeon (KR); Young Min Kim, Daejeon (KR); Eun Gi Son, Daejeon (KR); Joo Young Lee, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 68 days.

(21) Appl. No.: 18/261,216

(22) PCT Filed: Jul. 13, 2022

(86) PCT No.: PCT/KR2022/010170

§ 371 (c)(1),
(2) Date: Jul. 12, 2023

(87) PCT Pub. No.: WO2023/287185

PCT Pub. Date: Jan. 19, 2023

(65) Prior Publication Data

US 2024/0068460 A1 Feb. 29, 2024

(30) Foreign Application Priority Data

Jul. 14, 2021 (KR) ..... 10-2021-0092489
Jul. 12, 2022 (KR) ..... 10-2022-0085831

(51) Int. Cl.
*F04B 49/02* (2006.01)
*F04B 27/10* (2006.01)
*F04B 49/22* (2006.01)

(52) U.S. Cl.
CPC ..... *F04B 49/02* (2013.01); *F04B 27/10* (2013.01); *F04B 49/22* (2013.01)

(58) Field of Classification Search
CPC ..... F04B 49/02; F04B 49/22; F04B 27/14; F04B 27/24
See application file for complete search history.

(56) References Cited

U.S. PATENT DOCUMENTS 6,449,965 B1 * 9/2002 Murao ..... B60H 1/3208 62/133
10,876,778 B2 * 12/2020 Assouad ..... F25B 3/00
(Continued)

FOREIGN PATENT DOCUMENTS

EP 1336757 A2 * 8/2003 ..... F04B 27/1804
JP H1182300 A 3/1999
(Continued)

*Primary Examiner* — Thomas Fink
(74) *Attorney, Agent, or Firm* — Shumaker, Loop & Kendrick, LLP; James D. Miller

(57) ABSTRACT

A variable displacement swash plate type compressor control method and a variable displacement swash plate type compressor controlled thereby may include a first determination step of determining whether liquid refrigerant exists within the variable displacement swash plate type compressor; a first operation step of applying power to the field coil assembly and of not applying current to the electronic control valve, when it is determined in the first determination step S1 that the liquid refrigerant exists; a second determination step of comparing an elapsed period of time of operating in the first operation step with a predetermined reference time; and a second operation step of maintaining the power applied in the first operation step to the field coil assembly and applying current to the electronic control valve when the elapsed period of time is greater than or equal to the reference time.

15 Claims, 3 Drawing Sheets

(56) References Cited

U.S. PATENT DOCUMENTS

| | | | | |
|---|---|---|---|---|
| 2004/0194485 | A1* | 10/2004 | Dudley | F04B 49/10 62/472 |
| 2006/0179855 | A1* | 8/2006 | Lifson | F25B 13/00 62/160 |
| 2010/0178175 | A1* | 7/2010 | Koyama | F04C 18/0215 417/44.1 |
| 2010/0209272 | A1* | 8/2010 | Takai | F04B 49/225 417/437 |
| 2014/0308138 | A1* | 10/2014 | Pham | F04C 28/06 417/63 |
| 2018/0320672 | A1* | 11/2018 | Munroe | F04C 28/28 |

FOREIGN PATENT DOCUMENTS

| | | | | | |
|---|---|---|---|---|---|
| JP | 2004322845 | A | * | 11/2004 | |
| KR | 20110004161 | A | | 1/2011 | |
| KR | 20110035597 | A | | 4/2011 | |
| KR | 20160041450 | A | | 4/2016 | |
| KR | 20210074777 | A | | 6/2021 | |
| WO | WO-2017159553 | A1 | * | 9/2017 | F04B 27/18 |

* cited by examiner

VARIABLE DISPLACEMENT SWASH PLATE TYPE COMPRESSOR AND CONTROL METHOD

CROSS REFERENCE TO RELATED PATENT APPLICATIONS

This is a U.S. national phase patent application of PCT/KR2022/010170 filed Jul. 13, 2022 which claims the benefit of and priority to Korean Patent Application No. 10-2022-0085831 filed on Jul. 12, 2022 and Korean Patent Application No. 10-2021-0092489 filed on Jul. 14, 2021, the entire contents of each of which are incorporated herein by reference.

TECHNICAL FIELD

The present disclosure relates to a variable displacement swash plate type compressor control method and a variable displacement swash plate type compressor controlled thereby and more particularly to a variable displacement swash plate type compressor control method capable of reducing noise and vibration caused by liquid refrigerant, and a variable displacement swash plate type compressor controlled thereby.

BACKGROUND ART

In general, an air conditioner (A/C) for cooling and heating the interior of a vehicle is installed in the vehicle. The air conditioner is a component of a cooling system, and includes a compressor that compresses a low-temperature and low-pressure gaseous refrigerant introduced from an evaporator into a high-temperature and high-pressure gaseous refrigerant and sends it to a condenser.

The compressor includes a reciprocating type that compresses the refrigerant through a reciprocating motion of a piston and a rotary type that compresses the refrigerant while rotating. The reciprocating type includes a crank type that transmits power to a plurality of pistons by using a crank according to a power transmission method, a swash plate type that transmits power to a rotating shaft on which the swash plate is installed. The rotary type includes a vane rotary type using a rotating shaft and a vane, and a scroll type using an orbiting scroll and a fixed scroll.

Here, the swash plate type compressor has a swash plate rotating together with the rotating shaft and compresses the refrigerant by reciprocating a piston. Recently, for the purpose of improvement of the performance and efficiency of the compressor, the swash plate type compressor is formed in a so-called variable displacement type which controls the refrigerant discharge amount by controlling a stroke of the piston through the adjustment of an inclination angle of the swash plate.

Specifically, a conventional variable displacement swash plate type compressor includes a housing, a rotating shaft which is rotatably supported by the housing, a disk which is provided outside the housing and rotates together with the rotating shaft, a pulley which receives power from a driving source (e.g., an engine) and rotates, a field coil assembly which is magnetized when electric power is applied, and brings the disk into contact with the pulley, an elastic member which separates the disk from the pulley when electric power is not applied to the field coil assembly, a swash plate which is provided in a crankcase of the housing and rotates together with the rotating shaft, a piston which is provided in a bore of the housing and reciprocates by the swash plate, a valve mechanism which communicates and shields a compression chamber that is formed by the bore and the piston with and from a suction chamber and a discharge chamber of the housing, and an inclination adjustment mechanism which adjusts the inclination angle (an angle between a normal at the center of rotation of the swash plate and the rotating shaft) of the swash plate with respect to the rotating shaft.

Here, the inclination adjustment mechanism includes an inflow path for guiding the refrigerant in the discharge chamber to the crankcase and a discharge path for guiding the refrigerant in the crankcase to the suction chamber. The inflow path includes an electronic control valve (ECV) formed therein which adjusts the amount of the refrigerant flowing from the discharge chamber to the inflow path. The discharge path includes an orifice hole formed therein which reduces a fluid passing through the discharge path to a suction pressure, and thus, prevents a pressure increase of the suction chamber.

The variable displacement swash plate type compressor operates as follows.

That is, when a user starts a vehicle, the pulley rotates by receiving power from the driving source.

In this state, when the user starts the air conditioner, power is applied to the field coil assembly and at the same time current is applied to the electronic control valve.

Then, as power is applied to the field coil assembly, the disk is brought into contact with the pulley by an attractive force caused by magnetic induction. That is, the disk and the pulley are fastened. Then, the rotating shaft receives power from the driving source through the pulley and the disk and rotates, and the swash plate rotates together with the rotating shaft. Also, the piston converts the rotational motion of the swash plate into a linear motion and reciprocates within the bore. When the piston moves from the top dead center to the bottom dead center, the compression chamber communicates with the suction chamber by the valve mechanism and is shielded from the discharge chamber, so that the refrigerant in the suction chamber is sucked into the compression chamber. Also, when the piston moves from the bottom dead center to the top dead center, the compression chamber is shielded from the suction chamber and the discharge chamber by the valve mechanism, and the refrigerant in the compression chamber is compressed. Also, when the piston reaches the top dead center, the compression chamber is shielded from the suction chamber by the valve mechanism and communicates with the discharge chamber, so that the refrigerant compressed in the compression chamber is discharged to the discharge chamber.

Also, as the current is applied to the electronic control valve, the amount of the refrigerant flowing from the discharge chamber into the inflow path is controlled by the electronic control valve. As a result, the pressure in the crankcase is controlled, and the stroke of the piston is controlled. Also, the inclination angle of the swash plate is controlled, and the refrigerant discharge amount is controlled.

Meanwhile, when the user stops the vehicle or the air conditioner, the supply of the power applied to the field coil assembly and the supply of the current applied to the electronic control valve are stopped. Then, the attractive force by magnetic induction of the field coil assembly is not generated, and the disk is separated from the pulley by elastic force of the elastic member. That is, the fastening between the disk and the pulley is released. Then, the power transmission from the driving source to the rotating shaft is stopped, and the compression of the refrigerant is stopped.

However, in the conventional variable displacement swash plate type compressor and a control method for the same, when the variable displacement swash plate type compressor is started in the presence of liquid refrigerant, the liquid refrigerant is compressed and the load is increased, so that noise and vibration is increased.

Accordingly, the purpose of the present disclosure is to provide a variable displacement swash plate type compressor control method capable of reducing noise and vibration caused by liquid refrigerant, and a variable displacement swash plate type compressor controlled thereby.

SUMMARY

One embodiment is a variable displacement swash plate type compressor control method including: when a variable displacement swash plate type compressor is started which includes: a housing, a rotating shaft which is rotatably supported by the housing, a disk and a swash plate which rotate together with the rotating shaft, a pulley which receives power from a driving source and rotates, a field coil assembly which brings the disk into contact with the pulley when electric power is applied, a piston which reciprocates by the swash plate, and an inclination adjustment mechanism which adjusts an inclination angle of the swash plate with respect to the rotating shaft, a first determination step of determining a possibility that liquid refrigerant exists within the variable displacement swash plate type compressor; a first operation step of applying power to the field coil assembly and of not applying current to the electronic control valve, when it is determined in the first determination step S1 that the liquid refrigerant is highly likely to exist; a second determination step of comparing an elapsed period of time of operating in the first operation step with a predetermined reference time; and a second operation step of maintaining the power applied in the first operation step to the field coil assembly and of applying current to the electronic control valve when it is determined in the second determination step that the elapsed period of time is greater than or equal to the reference time.

In the second operation step, power may be applied to the field coil assembly and current may be applied to the electronic control valve, when it is determined in the first determination step that the liquid refrigerant is less likely to exist.

The first determination step may include a low temperature determination step of determining whether the variable displacement swash plate type compressor is in a low-temperature state.

In the low temperature determination step, it may be determined that the variable displacement swash plate type compressor is in a low-temperature state when a coolant temperature of a vehicle equipped with the variable displacement swash plate type compressor is lower than or equal to a predetermined reference temperature.

The reference temperature may be set to 50 degrees Celsius.

The first determination step may further include a long-term neglect determination step of determining whether the variable displacement swash plate type compressor is neglected for a long time.

In the long-term neglect determination step, it may be determined that the variable displacement swash plate type compressor is neglected for a long time when a heater controller which controls the variable displacement swash plate type compressor stops obtaining information.

When it is determined in the low temperature determination step that the variable displacement swash plate type compressor is in a low-temperature state and when it is determined in the long-term neglect determination step that the variable displacement swash plate type compressor is neglected for a long time, it may be determined that the liquid refrigerant is highly likely to exist.

When it is determined in the low temperature determination step that the variable displacement swash plate type compressor is not in a low-temperature state or when it is determined in the long-term neglect determination step that the variable displacement swash plate type compressor is not neglected for a long time, it may be determined that the liquid refrigerant is less likely to exist.

In the first operation step, the variable displacement swash plate type compressor may be started to be driven in a state where the inclination angle of the swash plate is a minimum value.

The minimum value may be set to be greater than zero.

The minimum value may be included in a range of 0.5 degrees or more and 0.7 degrees or less.

When it is determined in the second determination step that the elapsed period of time is less than the reference time, the control method may return to the first operation step.

The reference time may be set to any one value of three to five seconds.

A variable displacement swash plate type compressor which is controlled by the variable displacement swash plate type compressor control method is provided.

A variable displacement swash plate type compressor control method may include: when the variable displacement swash plate type compressor is started, a first determination step of determining a possibility that liquid refrigerant exists within the variable displacement swash plate type compressor; a first operation step of applying power to the field coil assembly and of not applying current to the electronic control valve, when it is determined in the first determination step S1 that the liquid refrigerant is highly likely to exist; a second determination step of comparing an elapsed period of time of operating in the first operation step with a predetermined reference time; and a second operation step of maintaining the power applied in the first operation step to the field coil assembly and of applying current to the electronic control valve when it is determined in the second determination step that the elapsed period of time is greater than or equal to the reference time. The variable displacement swash plate type compressor according to the embodiment of the present disclosure is controlled by the variable displacement swash plate type compressor control method, so that noise and vibration caused by the liquid refrigerant can be reduced when the variable displacement swash plate type compressor is started in the presence of liquid refrigerant.

DESCRIPTION OF AN EMBODIMENT

Hereinafter, a variable displacement swash plate type compressor control method according to an embodiment of the present disclosure and a variable displacement swash plate type compressor controlled thereby will be described in detail with reference to the accompanying drawings.

Figure 1:
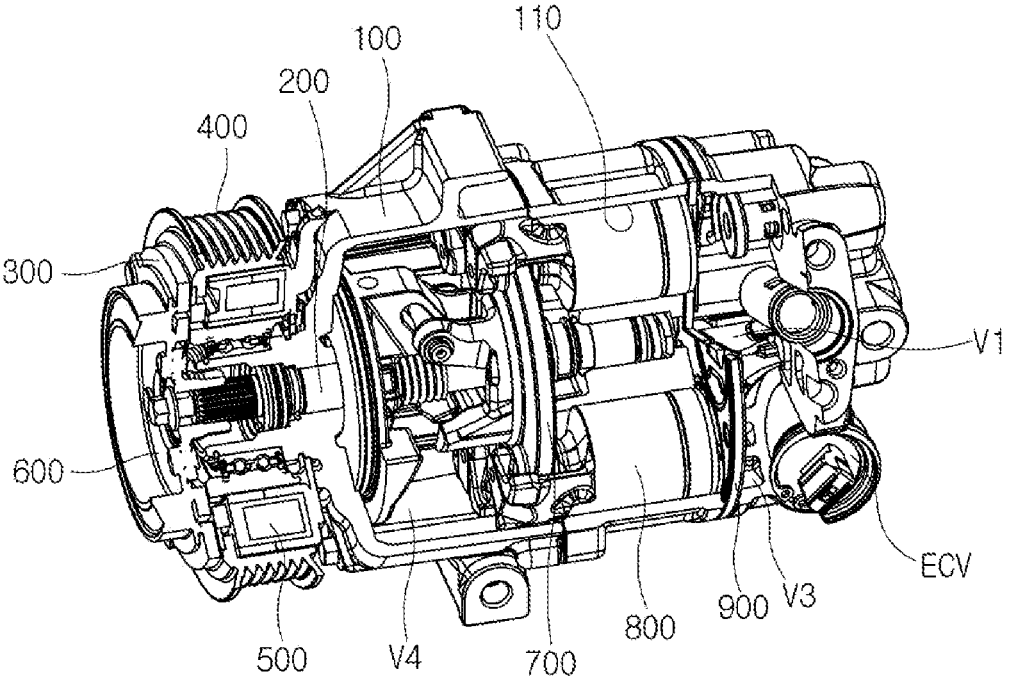
FIG. 1 is a perspective view showing a variable displacement swash plate type compressor according to an embodiment of the present disclosure.
Figure 2:
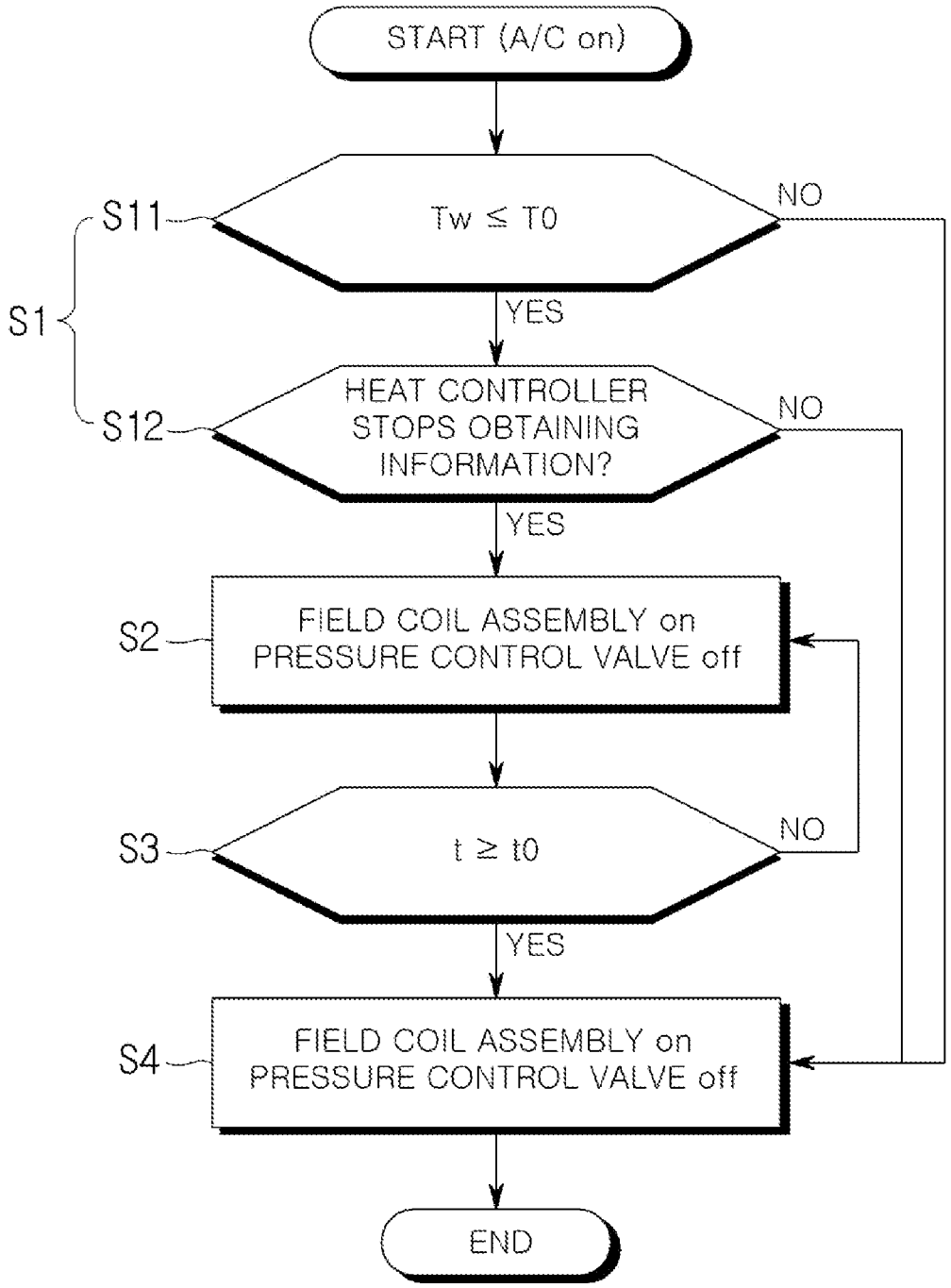
FIG. 2 is a flowchart showing a variable displacement swash plate type compressor control method according to the embodiment of the present disclosure.
Figure 3:
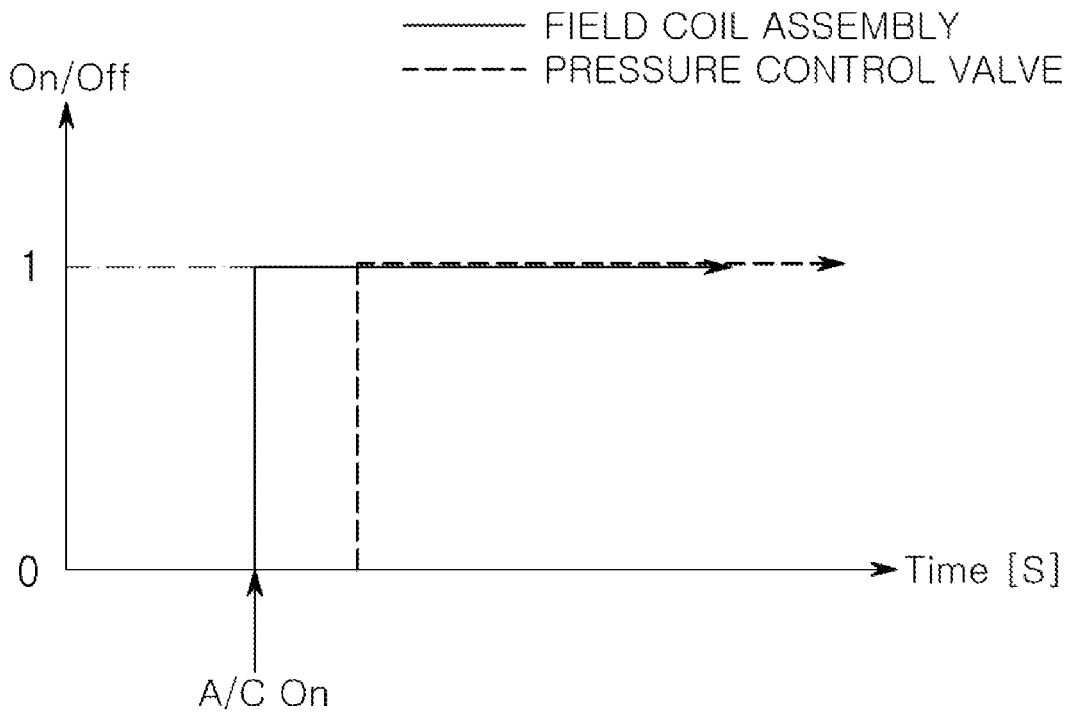
FIG. 3 is a graph showing on-off time points of a field coil assembly and an electronic control valve when the variable displacement swash plate type compressor of FIG. 1 is controlled by the variable displacement swash plate type compressor control method of FIG. 2.

FIG. 1 is a perspective view showing a variable displacement swash plate type compressor according to an embodiment of the present disclosure. FIG. 2 is a flowchart showing a variable displacement swash plate type compressor control method according to the embodiment of the present disclosure. FIG. 3 is a graph showing on-off time points of a field coil assembly and an electronic control valve when the variable displacement swash plate type compressor of FIG. 1 is controlled by the variable displacement swash plate type compressor control method of FIG. 2.

Referring to the attached FIG. 1, a variable displacement swash plate type compressor according to the embodiment of the present disclosure may include a housing 100, a rotating shaft 200 which is rotatably supported by the housing 100, a disk 300 which is provided outside the housing 100 and rotates together with the rotating shaft 200, a pulley 400 which receives power from a driving source (e.g., an engine) and rotates, a field coil assembly 500 which is magnetized when electric power is applied, and brings the disk 300 into contact with the pulley 400, an elastic member 600 which separates the disk 300 from the pulley 400 when electric power is not applied to the field coil assembly 500, a swash plate 700 which is provided in a crankcase V4 of the housing 100 and rotates together with the rotating shaft 200, a piston 800 which is provided in a bore 110 of the housing 100 and reciprocates by the swash plate 700, a valve mechanism 900 which communicates and shields a compression chamber that is formed by the bore 110 and the piston 800 with and from a suction chamber V1 and a discharge chamber V3 of the housing 100, and an inclination adjustment mechanism which adjusts an inclination angle (an angle between a normal at the center of rotation of the swash plate 700 and the rotating shaft 200) of the swash plate 700 with respect to the rotating shaft 200.

Here, the inclination adjustment mechanism includes an inflow path (not shown) for guiding a refrigerant in the discharge chamber V3 to the crankcase V4 and a discharge path (not shown) for guiding the refrigerant in the crankcase V4 to the suction chamber V1.

Also, the inflow path (not shown) includes an electronic control valve (ECV) formed therein which adjusts the amount of the refrigerant flowing from the discharge chamber V3 to the inflow path (not shown).

Also, the discharge path (not shown) includes an orifice hole formed therein which reduces a fluid passing through the discharge path (not shown) to a suction pressure, and thus, prevents a pressure increase in the suction chamber V1.

The variable displacement swash plate type compressor may operate as follows.

That is, when a user starts a vehicle, the pulley 400 may rotate by receiving power from the driving source.

In this state, when the user starts an air conditioner, power may be applied to the field coil assembly 500 and current may be applied to the electronic control valve ECV. Here, as shown in FIG. 3, even if power is applied to the field coil assembly 500, current may not be applied to the electronic control valve (ECV), which will be described later.

Subsequently, when power is applied to the field coil assembly 500, the disk 300 may come into contact with the pulley 400 by an attractive force caused by magnetic induction. That is, the disk 300 and the pulley 400 may be fastened. Then, the rotating shaft 200 receives power from the driving source through the pulley 400 and the disk 300 and rotates, and the swash plate 700 may rotate together with the rotating shaft 200. Also, the piston 800 may convert the rotational motion of the swash plate 700 into a linear motion and reciprocates within the bore 110. When the piston 800 moves from the top dead center to the bottom dead center, the compression chamber may communicate with the suction chamber V1 by the valve mechanism 900 and may be shielded from the discharge chamber V3, so that the refrigerant in the suction chamber V1 may be sucked into the compression chamber. Also, when the piston 800 moves from the bottom dead center to the top dead center, the compression chamber may be shielded from the suction chamber V1 and the discharge chamber V3 by the valve mechanism 900, and the refrigerant in the compression chamber may be compressed. Also, when the piston 800 reaches the top dead center, the compression chamber may be shielded from the suction chamber V1 by the valve mechanism 900 and may communicate with the discharge chamber V3, so that the refrigerant compressed in the compression chamber may be discharged to the discharge chamber V3.

Also, when the current is applied to the electronic control valve (ECV), the amount of the refrigerant flowing from the discharge chamber V3 into the inflow path (not shown) is controlled by the electronic control valve (ECV). As a result, the pressure in the crankcase V4 may be controlled, and the stroke of the piston 800 may be controlled. Also, the inclination angle of the swash plate 700 may be controlled, and the refrigerant discharge amount may be controlled.

Specifically, when a sum (hereinafter, referred to as a first moment) of a moment of the swash plate 700 due to the pressure in the crankcase V4 and a moment due to a return spring of the swash plate 700 is greater than a moment (hereinafter, referred to as a second moment) due to a compression reaction force of the piston 800, the inclination angle of the swash plate 700 may decrease, and when the second moment is greater than the first moment, and the inclination angle of the swash plate 700 may increase.

However, when the amount of the refrigerant flowing from the discharge chamber V3 into the inflow path (not shown) increases by the electronic control valve (ECV) and the amount of the refrigerant flowing into the crankcase V4 through the inflow path (not shown) increases, the pressure in the crankcase V4 may increase and the first moment may increase.

Here, the refrigerant in the crankcase V4 is discharged to the suction chamber V1 through the discharge path (not shown). However, when the amount of the refrigerant which flows from the discharge chamber V3 to the suction chamber V1 through the inflow path (not shown) is greater than the amount of the refrigerant which is discharged from the crankcase V4 to the suction chamber V1 through the discharge path (not shown), the pressure in the crankcase V4 may increase.

Also, when the first moment becomes greater than the second moment, the inclination angle of the swash plate 700 may be reduced, the stroke of the piston 800 may be reduced, and the refrigerant discharge amount may be reduced.

On the other hand, when the amount of the refrigerant flowing from the discharge chamber V3 into the inflow path (not shown) decreases by the electronic control valve (ECV) and the amount of the refrigerant flowing into the crankcase V4 through the inflow path (not shown) decreases, the pressure in the crankcase V4 may decrease and the first moment may decrease.

Here, even if the refrigerant in the discharge chamber V3 flows into the crankcase V4 through the inflow path (not shown), when the amount of the refrigerant which is discharged from the crankcase V4 to the suction chamber V1 through the discharge path (not shown) is greater than the amount of the refrigerant which flows from the discharge chamber V3 to the crankcase V4 through the inflow path (not shown), the pressure in the crankcase V4 may decrease.

Also, when the first moment becomes less than the second moment, the inclination angle of the swash plate 700 may be increased, the stroke of the piston 800 may be increased, and the refrigerant discharge amount may be increased.

Meanwhile, when the first moment and the second moment are equal to each other, the inclination angle of the swash plate 700 can be maintained in a steady state, and the stroke of the piston 800 and the refrigerant discharge amount can be maintained constant.

Here, since the compression reaction force of the piston 800 is proportional to the amount of compression, the compression reaction force of the piston 800 and the second moment may increase as the inclination angle of the swash plate 700 increases. Accordingly, the greater the inclination angle of the swash plate 700 is, the greater the pressure in the crankcase V4 for maintaining the inclination angle of the swash plate 700 may be. That is, the pressure in the crankcase V4 when the inclination angle of the swash plate 700 is maintained from a relatively large state to the steady state may be required to be larger than the pressure in the crankcase V4 when the inclination angle of the swash plate 700 is maintained from a relatively small state to the steady state.

Meanwhile, when the user stops the vehicle or the air conditioner, the supply of the power applied to the field coil assembly 500 and the supply of the current applied to the electronic control valve ECV may be stopped. Then, the attractive force by magnetic induction of the field coil assembly 500 is not generated, and the disk 300 may be separated from the pulley 400 by elastic force of the elastic member 600. That is, the fastening between the disk 300 and the pulley 400 may be released. Then, the power transmission from the driving source to the rotating shaft 200 is stopped, and the compression of the refrigerant may be stopped.

Here, the variable displacement swash plate type compressor according to the embodiment of the present disclosure can be controlled according to the variable displacement swash plate type compressor control method shown in FIG. 2.

Referring to FIG. 2, the variable displacement swash plate type compressor control method according to the embodiment of the present disclosure may include a first determination step S1 of determining a possibility that liquid refrigerant exists within the variable displacement swash plate type compressor when the variable displacement swash plate type compressor is started.

Here, when the variable displacement swash plate type compressor is neglected at a low temperature for a long time, on the basis of an analysis result that the liquid refrigerant is highly likely to exist within the variable displacement swash plate type compressor, the first determination step S1 may include a low temperature determination step S11 of determining whether the variable displacement swash plate type compressor is in a low-temperature state, and a long-term neglect determination step S12 of determining whether the variable displacement swash plate type compressor is neglected for a long time.

In the low temperature determination step S11, when a coolant temperature Tw of the vehicle equipped with the variable displacement swash plate type compressor is lower than or equal to a predetermined reference temperature TO (e.g., 50 degrees Celsius), it may be determined that the variable displacement swash plate type compressor is in a low-temperature state.

In the long-term neglect determination step S12, considering that a heater controller which controls the variable displacement swash plate type compressor obtains information for about 1 hour after the variable displacement swash plate type compressor stops and does not obtain information thereafter, when the heater controller stops obtaining information, it may be determined that the variable displacement swash plate type compressor is neglected for a long time.

Also, when it is determined in the low temperature determination step S11 that the variable displacement swash plate type compressor is in a low-temperature state and when it is determined in the long-term neglect determination step S12 that the variable displacement swash plate type compressor is neglected for a long time, it may be determined in the first determination step S1 that the liquid refrigerant is highly likely to exist.

Also, when it is determined in the low temperature determination step S11 that the variable displacement swash plate type compressor is not in a low-temperature state or when it is determined in the long-term neglect determination step S12 that the variable displacement swash plate type compressor is not neglected for a long time, it may be determined in the first determination step S1 that the liquid refrigerant is less likely to exist.

Here, in the present embodiment, the low temperature determination step S11 precedes the long-term neglect determination step S12. Also, the long-term neglect determination step S12 may precede the low temperature determination step S11 precedes.

Subsequently, the variable displacement swash plate type compressor control method may further include a first operation step S2 of applying power to the field coil assembly 500 and not applying current to the electronic control valve (ECV), when it is determined in the first determination step S1 that the liquid refrigerant is highly likely to exist.

Here, when the variable displacement swash plate type compressor is driven in the first operation step S2, the drive is started in a state where the inclination angle of the swash plate 700 is a minimum value, and the inclination angle of the swash plate 700 increases slightly by the compression reaction force while small pumping is performed, but is maintained at the minimum value. Here, the minimum value may be greater than zero (preferably, may be included in a range of 0.5 degrees or more and 0.7 degrees or less) such that the refrigerant can be compressed and discharged at a low flow rate.

Also, the variable displacement swash plate type compressor control method may further include a second determination step S3 of comparing an elapsed period of time t of operating in the first operation step S2 with a predetermined reference time t0 (e.g., any one value of three to five seconds). When it is determined in the second determination step S3 that the elapsed period of time t is greater than or equal to the predetermined reference time to, the control method proceeds to a second operation step S4 to be described later. When it is determined in the second determination step S3 that the elapsed period of time t is less than the reference time t0, the control method may return to the first operation step S2.

Also, the variable displacement swash plate type compressor control method may further include the second operation step S4. The second operation step S4 maintains the power applied in the first operation step S2 to the field coil assembly 500 and applies current to the electronic control valve (ECV) when it is determined in the second determination step S3 that the elapsed period of time t is greater than or equal to the reference time t0, and applies power to the field coil assembly 500 and applies current to the electronic control valve (ECV) when it is determined in the first determination step S1 that the liquid refrigerant is less likely to exist.

Here, as the variable displacement swash plate type compressor according to the embodiment of the present disclosure is controlled by the variable displacement swash plate type compressor control method, noise and vibration caused by the liquid refrigerant can be reduced.

Specifically, referring to FIGS. 2 and 3, when the variable displacement swash plate type compressor is started in a state in which the liquid refrigerant is highly likely to exist, it is determined in the first determination step S1 that the liquid refrigerant is highly likely to exist, so that, in the first operation step S2, power may be applied only to the field coil assembly 500 and current may not be applied to the electronic control valve (ECV). Accordingly, the variable displacement swash plate type compressor is driven in a state where the inclination angle of the swash plate 700 is the minimum value, so that the refrigerant can be compressed and discharged at a low flow rate. As a result of this, the liquid refrigerant present within the variable displacement swash plate type compressor can be discharged to the outside without increasing noise and vibration. In addition, this state can be maintained until the second operation step S4 is performed by the second determination step S3. That is, after the first operation step S2 continues for the reference time to, the control method may proceed to the second operation step S4 in which the power applied in the first operation step S2 to the field coil assembly 500 is maintained and current is applied to the electronic control valve (ECV). Accordingly, the variable displacement swash plate type compressor can be normally driven in a state in which the liquid refrigerant is removed.

On the other hand, when the variable displacement swash plate type compressor is started in a state in which the liquid refrigerant is less likely to exist, it is determined in the first determination step S1 that the liquid refrigerant is less likely to exist, so that the control method may proceed directly to the second operation step S4 in which power is applied to the field coil assembly 500 and current is applied to the electronic control valve (ECV). That is, the variable displacement swash plate type compressor can be normally driven immediately.

In conclusion, as the liquid refrigerant with low noise and vibration is discharged and normal driving is performed without the liquid refrigerant, noise and vibration caused by the liquid refrigerant can be reduced.

The invention claimed is:

1. A variable displacement swash plate type compressor control method comprising:

when a variable displacement swash plate type compressor is started which includes: a housing, a rotating shaft which is rotatably supported by the housing, a disk and a swash plate which rotate together with the rotating shaft, a pulley which receives mechanical power from a driving source and rotates, a field coil assembly which brings the disk into contact with the pulley when electric power is applied, a piston which reciprocates by the swash plate, and an inclination adjustment mechanism which adjusts an inclination angle of the swash plate with respect to the rotating shaft, a first determination step of determining a possibility that liquid refrigerant exists within the variable displacement swash plate type compressor;

a first operation step of applying electrical power to the field coil assembly and of not applying current to an electronic control valve, when it is determined in the first determination step that the liquid refrigerant is highly likely to exist;

a second determination step of comparing an elapsed period of time of operating in the first operation step with a predetermined reference time; and a second operation step of maintaining the electrical power applied in the first operation step to the field coil assembly and of applying current to the electronic control valve when it is determined in the second determination step that the elapsed period of time is greater than or equal to the predetermined reference time.

2. The variable displacement swash plate type compressor control method of claim 1, wherein, in the second operation step, the electrical power is applied to the field coil assembly and current is applied to the electronic control valve, when it is determined in the first determination step that the liquid refrigerant is less likely to exist.

3. The variable displacement swash plate type compressor control method of claim 1, wherein the first determination step comprises a low temperature determination step of determining whether the variable displacement swash plate type compressor is in a low-temperature state.

4. The variable displacement swash plate type compressor control method of claim 3, wherein, in the low temperature determination step, it is determined that the variable displacement swash plate type compressor is in the low-temperature state when a coolant temperature of a vehicle equipped with the variable displacement swash plate type compressor is lower than or equal to a predetermined reference temperature.

5. The variable displacement swash plate type compressor control method of claim 4, wherein the predetermined reference temperature is set to 50 degrees Celsius.

6. The variable displacement swash plate type compressor control method of claim 3, wherein the first determination step further comprises a long-term neglect determination step of determining whether the variable displacement swash plate type compressor is neglected for a predetermined amount of time.

7. The variable displacement swash plate type compressor control method of claim 6, wherein, in the long-term neglect determination step, it is determined that the variable displacement swash plate type compressor is neglected for the predetermined amount of time when a heater controller which controls the variable displacement swash plate type compressor stops obtaining information.

8. The variable displacement swash plate type compressor control method of claim 6, wherein, when it is determined in the low temperature determination step that the variable displacement swash plate type compressor is in the low-temperature state and when it is determined in the long-term neglect determination step that the variable displacement swash plate type compressor is neglected for the predetermined amount of time, it is determined that the liquid refrigerant is highly likely to exist.

9. The variable displacement swash plate type compressor control method of claim 6, wherein, when it is determined in the low temperature determination step that the variable displacement swash plate type compressor is not in the low-temperature state or when it is determined in the long-term neglect determination step that the variable displacement swash plate type compressor is not neglected for the predetermined amount of time, it is determined that the liquid refrigerant is less likely to exist.

10. The variable displacement swash plate type compressor control method of claim 1, wherein, in the first operation step, the variable displacement swash plate type compressor is started to be driven in a state where the inclination angle of the swash plate is a predetermined minimum value.

11. The variable displacement swash plate type compressor control method of claim 10, wherein the predetermined minimum value is set to be greater than zero.

12. The variable displacement swash plate type compressor control method of claim 11, wherein the predetermined minimum value is included in a range of 0.5 degrees or more and 0.7 degrees or less.

13. The variable displacement swash plate type compressor control method of claim 1, wherein, when it is determined in the second determination step that the elapsed period of time is less than the predetermined reference time, the variable displacement swash plate type compressor control method returns to the first operation step.

14. The variable displacement swash plate type compressor control method of claim 1, wherein the predetermined reference time is set to any one value of three to five seconds.

15. The variable displacement swash plate type compressor controlled by the variable displacement swash plate type compressor control method according to claim 1.

* * * * *